US008602957B2

(12) United States Patent
Sandahl

(10) Patent No.: US 8,602,957 B2
(45) Date of Patent: Dec. 10, 2013

(54) INCREMENTAL VELOCITY CHANGING APPARATUS FOR TRANSPORTING PRINTED PRODUCTS IN A PRINTING PRESS FOLDER

(75) Inventor: Kyle Albert Sandahl, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 956 days.

(21) Appl. No.: 12/288,070

(22) Filed: Oct. 16, 2008

(65) Prior Publication Data

US 2010/0099544 A1 Apr. 22, 2010

(51) Int. Cl.
*B65H 29/20* (2006.01)

(52) U.S. Cl.
USPC ..... 493/362; 493/324; 493/359

(58) Field of Classification Search
USPC ..... 493/324, 362, 320, 340, 359
See application file for complete search history.

(56) References Cited

U.S. PATENT DOCUMENTS

| | | | | |
|---|---|---|---|---|
| 3,827,545 | A * | 8/1974 | Buhayar | 198/461.2 |
| 3,890,886 | A | 6/1975 | Fessler et al. | 93/93 D |
| 4,159,823 | A * | 7/1979 | Bryer et al. | 493/369 |
| 4,380,449 | A * | 4/1983 | Michalik | 493/424 |
| 4,417,516 | A | 11/1983 | Fischer | 101/181 |
| 5,024,128 | A | 6/1991 | Campell, Jr. | |
| 5,088,590 | A * | 2/1992 | Marschke | 198/461.1 |
| 5,520,383 | A | 5/1996 | Amagai et al. | |
| 5,641,156 | A | 6/1997 | Nukada et al. | |
| 5,695,105 | A | 12/1997 | Ohara | |
| 5,794,927 | A | 8/1998 | Uchida | |
| 6,170,371 | B1 | 1/2001 | Cote et al. | |
| 6,170,820 | B1 | 1/2001 | Hutson | |
| 6,428,001 | B1 | 8/2002 | Jackson | 271/270 |
| 6,687,570 | B1 | 2/2004 | Sussmeier et al. | |
| 6,705,981 | B2 * | 3/2004 | Bergeron et al. | 493/370 |
| 6,761,676 | B2 | 7/2004 | Wingate et al. | |
| 7,305,921 | B2 * | 12/2007 | Scholzig et al. | 101/232 |
| 2003/0033915 | A1 | 2/2003 | Glemser et al. | |
| 2010/0101386 | A1 * | 4/2010 | Jackson et al. | 83/37 |

* cited by examiner

*Primary Examiner* — Christopher Harmon
(74) *Attorney, Agent, or Firm* — Davidson, Davidson & Kappel, LLC

(57) ABSTRACT

A printing press folder is provided. The printing press folder includes a pair of cutting cylinders cutting a web at a cutting location to form signatures, a pair of transport cylinders positively gripping and transporting the signatures and a pair of acceleration cylinders positively gripping and transporting the signatures. The transport cylinders define a first nip and the first nip and the cutting location are separated by a first distance that is slightly shorter than a length of each of the signatures. The acceleration cylinders define a second nip. The pair of transport cylinders receives and releases signatures at a first velocity and the pair of acceleration cylinders receives the signatures from the pair of transport cylinders and releases the signatures at a second velocity that is greater than the first velocity. The first nip and the second nip are separated by a distance that is slightly shorter than the length of each of the signatures, such that the transport cylinders release each of the signatures as the acceleration cylinders grip the respective signature and the transport and acceleration cylinders maintain positive control over the signatures during transport. A signature transport apparatus and a method for transporting printed products in a printing press folder are also provided.

14 Claims, 2 Drawing Sheets

INCREMENTAL VELOCITY CHANGING APPARATUS FOR TRANSPORTING PRINTED PRODUCTS IN A PRINTING PRESS FOLDER

The present invention relates generally to printing presses, and more particularly to an incremental velocity changing apparatus for transporting printed products in a folder of a printing press.

BACKGROUND OF THE INVENTION

U.S. Pat. No. 5,103,703 discloses a sheet cutting apparatus for severing a rapidly-moving web, such as printed paper, into cut sheets in two stages. In the first stage, spaced cuts are made along a transverse cutting line of the web. The web is trained between belts which support the cut portions of the web, and the uncut portions of the web are severed to separate sheets. The sheets are conveyed out of the cutting station and into further apparatus. Preferably, the belts for supporting the web during the second cutting operation are trained around the knife and anvil rolls which make the cuts. The purpose of the belts is to prevent the leading edge of the web or a cut sheet from being projected forward of its support, thus tending to become dog-eared or misfed. The cuts made at the first and second cutting stations can be arranged in various patterns to remedy mis-timing of the respective cutting stations.

U.S. Pat. No. 5,695,105 discloses an apparatus for cutting a web at a predetermined length and supplying the same. A cutting roller is provided on its peripheral surface with projecting cutting blades arranged at predetermined intervals circumferentially and extending axially out of the cutting roller. The cutting blades are pressed against the peripheral surface of the receiving roller so as to cut the portion of the web which has passed between the cutting and receiving rollers at a predetermined length. At the downstream side of the cutting means there is provided accelerating means which has a pair of accelerating rollers sandwiching the web and sending the web in the transporting direction at a speed slightly higher than the speed which the cutting means provides.

U.S. Pat. No. 6,761,676 discloses a tape transport system for printed products comprising a first tape, a pulley supporting the tape, and a lever arm supporting the pulley, the lever arm including a first side rail and a second side rail, the pulley supported rotatably between the first and second side rails to form a narrow mechanism.

SUMMARY OF THE INVENTION

A printing press folder is provided. The printing press folder includes a pair of cutting cylinders cutting a web at a cutting location to form signatures, a pair of transport cylinders positively gripping and transporting the signatures and a pair of acceleration cylinders positively gripping and transporting the signatures. The transport cylinders define a first nip and the first nip and the cutting location are separated by a first distance that is slightly shorter than a length of each of the signatures. The acceleration cylinders define a second nip. The pair of transport cylinders receives and releases signatures at a first velocity and the pair of acceleration cylinders receives the signatures from the pair of transport cylinders and releases the signatures at a second velocity that is greater than the first velocity. The first nip and the second nip are separated by a distance that is slightly shorter than the length of each of the signatures, such that the transport cylinders release each of the signatures as the acceleration cylinders grip the respective signature and the transport and acceleration cylinders maintain positive control over the signatures during transport.

A signature transport apparatus is also provided. The signature transport apparatus includes a pair of first acceleration cylinders positively gripping and transporting the signatures and a pair of second acceleration cylinders positively gripping and transporting the signatures. The first acceleration cylinders define a first nip and the second acceleration cylinders define a second nip. The pair of first acceleration cylinders receive the signatures at a first velocity and a release the signatures at a second velocity and the pair of second acceleration cylinders receive the signatures from the pair of first acceleration cylinders and release the signatures at a third velocity. The first nip and the second nip are separated by a distance that is slightly shorter than the length of each of the signatures, such that the first acceleration cylinders release each of the signatures as the second acceleration cylinders grip the respective signature and the first and second acceleration cylinders maintain positive control over the signatures during acceleration.

A method for transporting printed products in a printing press folder is also provided. The method includes the steps of engaging a signature traveling at a first velocity with a pair of first acceleration cylinders, accelerating the signature and releasing the signatures from the pair of first acceleration cylinders at a second velocity, engaging the signature with a pair of second acceleration cylinders just before the signature is released from the pair of first acceleration cylinders so the first and second acceleration cylinders maintain positive control of the signature, and accelerating the signature and releasing the signature from the pair of second acceleration cylinders at a third velocity.

BRIEF DESCRIPTION OF THE DRAWINGS

The present invention is described below by reference to the following drawings, in which.

DETAILED DESCRIPTION

In the web offset printing process, a continuous web of paper is transported through a printing press. One or more printing units apply ink to the web to repeatedly create a pattern, or impression, of text and images. A slitter may slit the web into ribbons, which may be longitudinally folded by a former. For the purposes of the present application, the term web also includes ribbons. A web conversion machine, such as a folder, may be used to cut the web into signatures and fold the signatures.

Many folders use driven belts or tapes to transport signatures from a cut cylinder to a next operation, such as signature deceleration or folding. These tapes contact the web before the signature is created and have a surface velocity higher than that of the web. The tapes may mark the web or smear the text and images printed on the web.

After a signature is created by the cut cylinder, the signature may be accelerated by the tapes from the velocity of the web to the surface velocity of the tapes. The difference between the velocity of the web and the velocity of the tapes, the velocity gain, may be up to 16%. The velocity gain may cause the signature to slip in relation to the tapes. The amount of slip may be dependent upon a number of variables, including tape contact pressure, thickness of the signature, whether the signature has a glossy or matte finish, the amount of ink and silicone coverage, or the condition of the tapes.

The rate of signature acceleration or deceleration may depend on the mass of the signature and on the normal force and coefficient of friction between the tapes and the signature. These factors may cause position variations in the signature when the signature reaches the next device, such as a fan or jaw cylinder. Slipping may cause position variations, which can include: signature-to-signature variation at a given press speed, variations due to press speed changes, and variations over time due to, for example, tape wear. Position variations may cause the following problems: reduced maximum allowable press speed, increased need for manual phase adjustments, machine damage, and press downtime due to jammed signatures. Such problems may be worse in variable cutoff applications and may become worse as press speeds increase.

Effects of varying friction may be controlled by minimizing a distance between the cut cylinder and the tapes and by adding an adjustable "S" wrap roll configuration.

Figure 1:
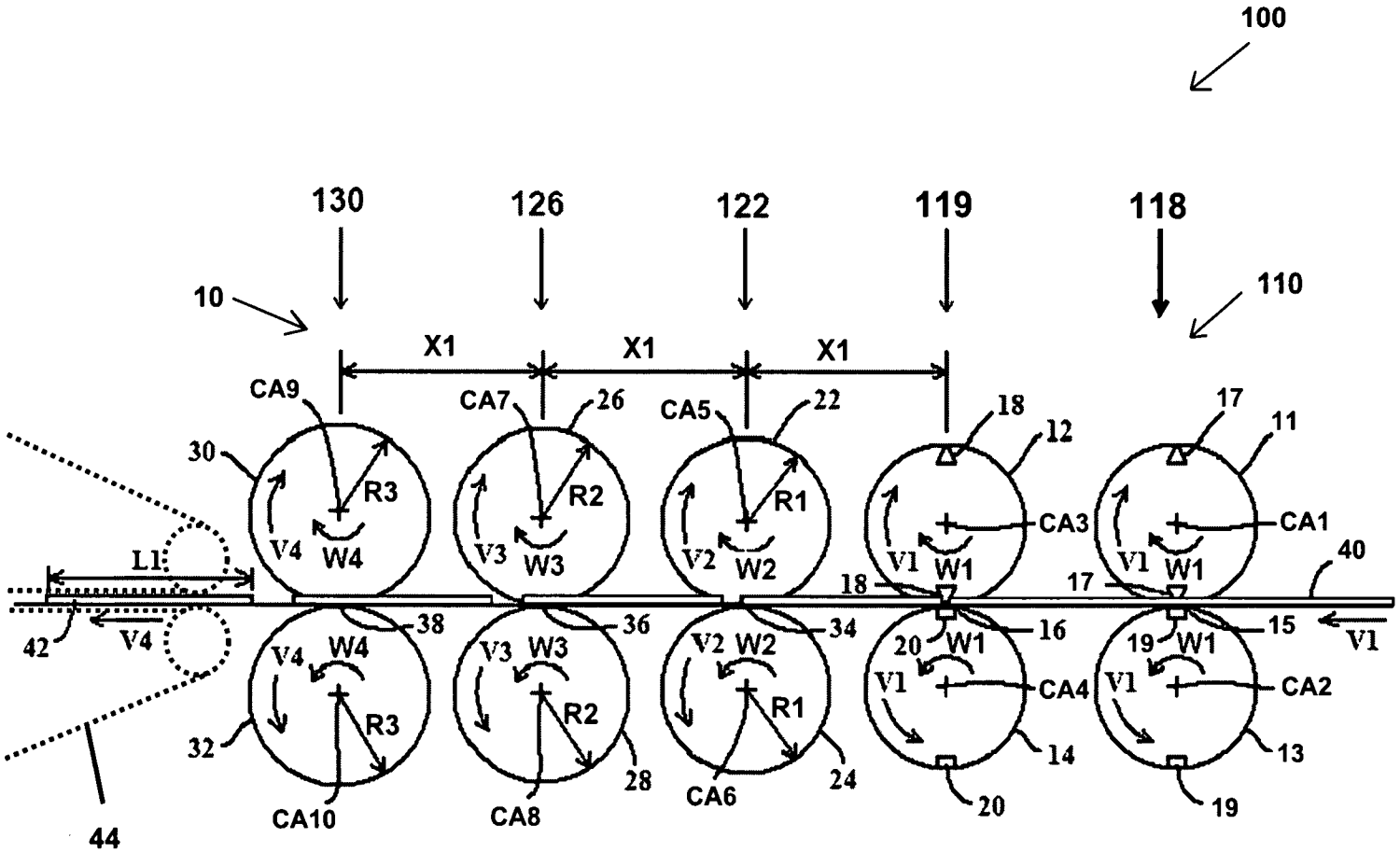
FIG. 1 schematically shows a portion of a printing press folder including a signature transport apparatus according to one embodiment of the present invention.

FIG. 1 shows a schematic side view of a portion of a printing press folder 100 according to an embodiment of the present invention including a signature transport apparatus 10 and a cutting apparatus 110. Signature transport apparatus 10 includes transport pair 122 and acceleration pairs 126, 130 and cutting apparatus 110 includes cutting pairs 118, 119. Cutting pairs 118, 119 include cutting cylinders 11, 12 and anvil cylinders 13, 14, respectively. Cylinders 11, 13 are rotated about respective center axes CA1, CA2 at an angular velocity W1. Cylinders 12, 14 may also be rotated about respective center axes CA3, CA4 at angular velocity W1. Cutting cylinders 11, 12 have respective knives 17, 18 which engage anvils 19, 20 of anvil cylinders 13, 14, respectively, at cutting locations 15, 16, respectively. Knives 17 are segmented and partially cut, or perforate, web 40 by contacting anvils 19 on anvil cylinder 13. Web 40 travels at a velocity V1. Cutting cylinder 12 includes knives 18 that finish the partial cuts by knives 17, forming signatures 42, by contacting anvils 20 on anvil cylinder 14. Knives 18 may also be segmented. Knives 17 may be phased with respect to knives 18 to create signatures 42 of a length L1.

Acceleration pairs 126, 130 receive signatures 42 from transport pair 122 and incrementally increase the velocity of signatures 42 as signatures 42 travel away from cutting pair 119. Transport pair 122 includes transport cylinders 22, 24, each having a radius R1 and rotating about a respective center axis CA5, CA6 at an angular velocity W2. Acceleration pair 126 includes acceleration cylinders 26, 28, each having a radius R2 and rotating about a respective center axis CA7, CA8 at an angular velocity W3. Acceleration pair 130 includes acceleration cylinders 30, 32, each having a radius R3 and rotating about a respective center axis CA9, CA10 at an angular velocity W4. Pairs 122, 126, 130 contact web 40 at nips 34, 36, 38, respectively.

Just prior to or as web 40 is cut by cutting pair 119, transport pair 122 engages signatures 42 at nip 34. Surfaces of cylinders 22, 24 of transport pair 122 are traveling at a velocity V2, which is equal to velocity V1. Transport pair 122 passes signatures 42 to acceleration pair 126 at velocity V2. Surfaces of cylinders 26, 28 of acceleration pair 126 travel at a velocity V3, which is greater than velocity V2. Thus, cylinders 26, 28 engage signatures 42 at nip 36 and accelerate signatures 42 from velocity V2 to velocity V3. Acceleration pair 126 passes signatures 42 to acceleration pair 130 at velocity V3. Surfaces of cylinders 30, 32 of acceleration pair 130 travel at a velocity V4, which is greater than velocity V3. Thus, cylinders 30, 32 engage signatures 42 at nip 38 and accelerate signatures 42 from velocity V3 to velocity V4.

Signatures 42 may be delivered by acceleration pair 130 to transport tapes 44 and carried by transport tapes 44 away from nip 38 at velocity V4. To ensure signatures 42 are always contacting a nip within signature transport apparatus 10, a signature length L1 may be slightly longer than a distance X1 between adjacent nips 16, 34, 36, 38.

Guide belts may be provided to assist in guiding signatures through signature transport apparatus 10. The guide belts may be provided in circumferential cutouts spaced axially in cylinders 12, 14, 22, 24, 26, 28, 30, 32.

Acceleration pairs 126, 130 gradually accelerate signatures 42 from velocity V2 to velocity V4 in increments, with each acceleration pair 126, 130 involved in a discrete step of acceleration. Velocities V3, V4 may be chosen such that the discrete steps of acceleration are each small enough to minimize or eliminate slippage between pairs 122, 126, 130 and the signature. Thus, signature transport apparatus 10 may maintain positive control over signatures 42 and reduce problems associated with signature position errors while greatly reducing or eliminating reliance on the consistency of a controlled slip.

In one embodiment, cylinders 22, 24, 26, 28, 30, 32 may be geared together and driven by a common drive such that angular velocities W2, W3, W4 are equal. The common drive may be velocity matched to a cut cylinder drive driving cylinders 11, 12, 13, 14 so that as cylinders 22, 24 grip web 40, V2 is equal to a velocity that knives 18 are traveling with respect to the direction of the web. When W2, W3, W4 are equal, radiuses R1, R2, R3 are gradually increased so that surface velocities V3, V4 gradually increase and signatures 42 are accelerated as signatures 42 travel away from cutting pair 119.

In another embodiment, cylinders 22, 24 may be driven by a first motor, cylinders 26, 28 may be driven by a second motor and cylinders 30, 32 may be driven by a third motor. The desired surface velocities V2, V3, V4 may thus be obtained with radii R1, R2, R3 being equal and angular velocities W2, W3, W4 being unequal.

In another embodiment, cylinders 22, 24, 26, 28, 30, 32 may be driven by the same belt or belts.

In further embodiments, acceleration pairs 126, 130 may be used in other printed product processing equipment and, may be used to decelerate, rather than accelerate, signatures 42. Roll radii R2, R3 and angular velocities W3, W4 of cylinders 26, 28, 30, 32 may be chosen to provide a desired deceleration rate.

Figure 2:
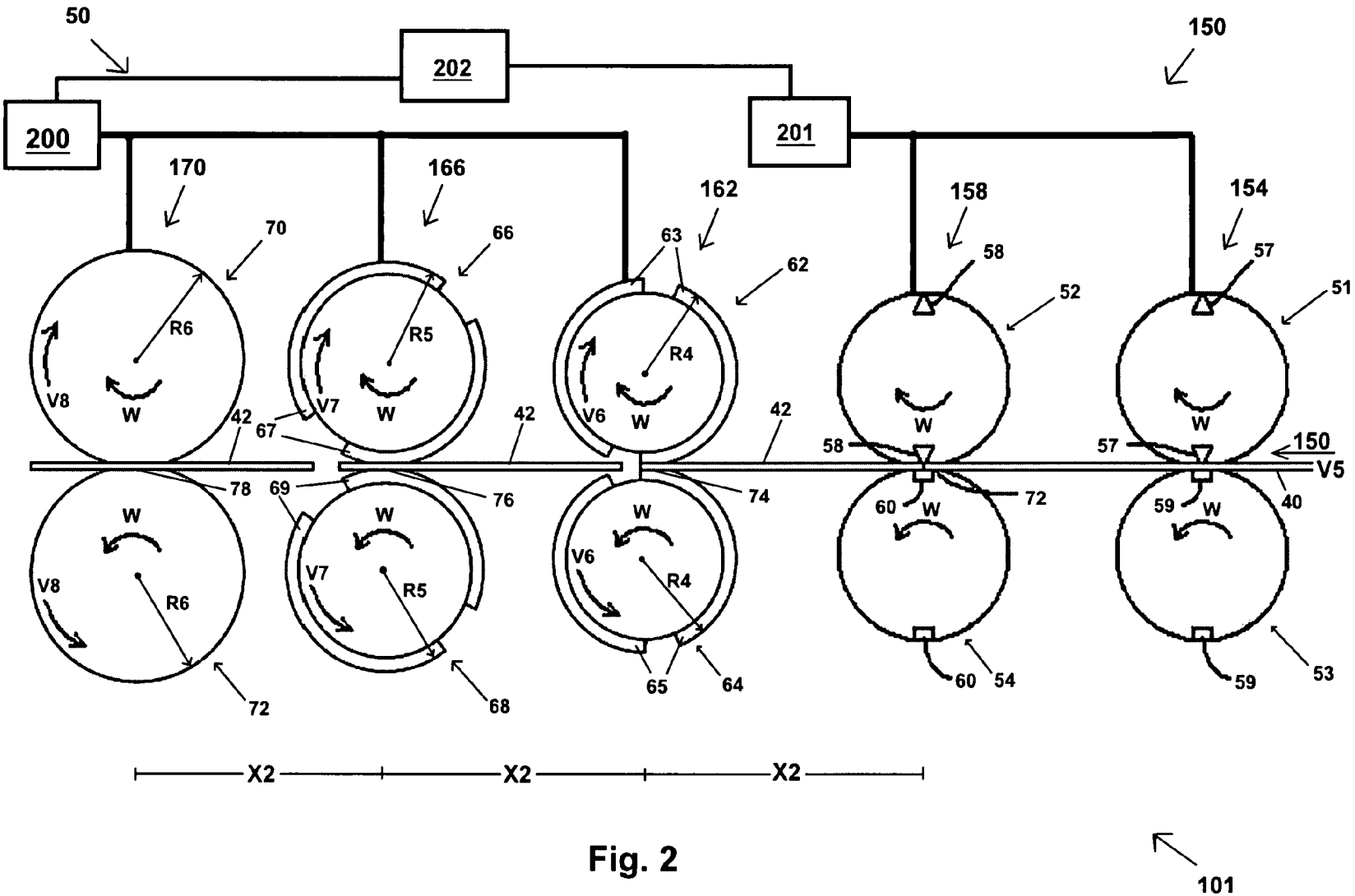
FIG. 2 schematically shows a portion of a printing press folder including a signature transport apparatus according to another embodiment of the present invention.

FIG. 2 shows a schematic side view of a portion of a printing press folder 101 according to an embodiment of the present invention including a signature transport apparatus 50 and a cutting apparatus 150. Signature transport apparatus 50 includes transport pair 162 and acceleration pairs 166, 170 and cutting apparatus 110 includes cutting pairs 154, 158. Acceleration pairs 166, 170 incrementally accelerate signatures 42 in a manner similar to acceleration pairs 126, 130 shown in FIG. 1.

Pairs 162, 166, 170 form nips 74, 76, 78, respectively, spaced at intervals of a distance X2. Cutting pair 158 cuts web 40 at a cutting location 72, which may be a distance X2 away from nip 74. Distance X2 may be slightly less than length L1 of signatures 42 (FIG. 1).

Cutting pairs 154, 158 cut a web 40 traveling in a direction 150 into signatures 42 using respective cutting cylinders 51, 52 and respective anvil cylinders 53, 54. Cutting cylinder 51 may include segmented knives 57 that partially cut, or perforate, web 40 by contacting anvils 59 on anvil cylinder 53. Cutting cylinder 52 includes knives 58 that finish the partial cuts created by knives 57, forming signatures 42, by contacting anvils 60 on anvil cylinder 54. Knives 58 may also be segmented.

Cylinders 62, 64, each have a surface velocity V6 and engage web 40, traveling at a velocity V5 that equals velocity V6, as cutting pair 158 cuts web 40 to forms signatures 42. Cylinders 62, 64 transport signatures 42, so that signatures 42 travel at a velocity V6 as signatures 42 are passed to acceleration pair 166. Cylinders 62, 64 include surface roll segments 63, 65, respectively, that radially protrude from cylinders 62, 64 and engage signatures 42 at nip 74. Surface roll segments 63, 65 may be of a length equal to distance X2 and may be spaced about cylinders 62, 64, respectively, such that gaps between segments 63 and gaps between segments 65 allow tail edges of signatures 42 to smoothly release from cylinders 62, 64. Cylinders 62, 64 may be phased so that a tail edge of each signature 42 is released as each signature 42 is grabbed by acceleration pair 166.

Cylinders 66, 68, each have a surface velocity V7 and engage signatures 42 as signatures 42 are released by transport pair 162. Cylinders 66, 68 transport and accelerate signatures 42, so that signatures 42 travel at a velocity V7 as signatures 42 are passed to acceleration pair 170. Cylinders 66, 68 include surface roll segments 67, 69, respectively, that radially protrude from cylinders 66, 68 and engage signatures 42 at nip 76. Surface roll segments 67, 69 may be of a length equal to distance X2 and may be spaced about cylinders 66, 68, respectively, such that gaps between segments 67 and gaps between segments 69 allow tail edges of signatures 42 to smoothly release from cylinders 66, 68. Cylinders 66, 68 may be phased so that a tail edge of each signature 42 is released as each signature 42 is grabbed by acceleration pair 170.

Cylinders 70, 72, each have a surface velocity V8 and engage signatures 42 as signatures 42 are released by acceleration pair 166. Cylinders 70, 72 transport and accelerate signatures 42, so that signatures 42 travel at a velocity V8 as signatures 42 are passed away from signature transport apparatus 50. Cylinders 70, 72 may have a constant surface, without surface roll segments, because acceleration pair 170 may release signatures 42 to belts traveling at velocity V8. In one embodiment, cylinders 70, 72 may include surface roll segments.

In a preferred embodiment, cylinders 62, 64, 66, 68, 70, 72 are driven by a common motor 200 at an angular velocity W. Cylinders 51, 52, 53, 54 may be driven by a motor 201 at angular velocity W, or some other angular velocity. A controller 202 may be provided to control motors 200, 201 as desired. In order for acceleration pairs 166, 170 to accelerate signatures 42, cylinders 62, 64, 66, 68, 70, 72 have increasingly larger pitch radii in each pair 162, 166, 170, in relation to direction 150. Cylinders 66, 68 each have a pitch radius R5 greater than a pitch radius R4 of each cylinder 62, 64 and cylinders 70, 72 each have a radius R6 greater than pitch radius R5. In another embodiment, signature acceleration apparatus 50 is used in a different printed product processing machine and radii R4, R5, R6 decrease in direction 150 so that signature acceleration apparatus 50 decelerates signatures.

With cylinders 62, 64, 66, 68, 70, 72 being rotated at the same angular velocity W, the velocity gain of each acceleration pair 166, 170 is controlled by radii R4, R5, R6 of cylinders 62, 64, 66, 68, 70, 72. A theoretical limit to a maximum velocity gain may be distance X2. An actual limit to a maximum velocity gain may be dependent upon a point at which there is slippage between pairs 162, 166, 170 and signatures 42.

The number of acceleration cylinders in a signature transport apparatus may be increased or decreased in a signature transport apparatus to achieve a desired rate of acceleration or deceleration, thus a signature transport apparatus may include two acceleration pairs or more than three acceleration pairs.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A printing press folder comprising:

a pair of cutting cylinders cutting a web at a cutting location to form signatures;

a pair of transport cylinders positively gripping and transporting the signatures, the transport cylinders defining a first nip, the transport cylinders each having a radius of a first length, the first nip and the cutting location being separated by a first distance that is slightly shorter than a length of each of the signatures; and a pair of acceleration cylinders positively gripping and transporting the signatures, the acceleration cylinders defining a second nip, acceleration cylinders each having a radius of a second length greater than the first length, the pair of transport cylinders receiving and releasing the signatures at a first velocity and the pair of acceleration cylinders receiving the signatures from the pair of transport cylinders and releasing the signatures at a second velocity that is greater than the first velocity, the first nip and the second nip being separated by a distance that is slightly shorter than the length of each of the signatures, such that the transport cylinders release each of the signatures as the acceleration cylinders grip the respective signature and the transport and acceleration cylinders maintain positive control over the signatures during transport; and a motor rotating the transport cylinders and the acceleration cylinders at a same angular velocity such that transport cylinders have a surface velocity less than a surface velocity of the acceleration cylinders.

2. The printing press folder recited in claim 1 wherein each transport cylinder includes first surface roll segments radially protruding from the respective transport cylinder and engaging signatures at the first nip.

3. The printing press folder recited in claim 2 wherein the first surface roll segments are spaced about each respective transport cylinder such that gaps between segments cause the transport cylinders to release the signatures.

4. The printing press folder recited in claim 2 wherein the first surface roll segments each have a surface length that is slightly shorter than the length of each of the signatures.

5. The printing press folder recited in claim 1 further comprising a pair of second acceleration cylinders positively gripping and transporting the signatures, the second acceleration cylinders defining a third nip, the pair of second acceleration cylinders receiving the signatures from the pair of acceleration cylinders and releasing the signatures at a third velocity that is greater than the second velocity, the second nip and the third nip being separated by a distance that is slightly shorter than the length of each of the signatures, such that the acceleration cylinders release each of the signatures as the second acceleration cylinders grip the respective signature and the acceleration cylinders and second acceleration cylinders maintain positive control over the signatures during transport.

6. A signature transport apparatus comprising:

a pair of first acceleration cylinders positively gripping and transporting signatures, the first acceleration cylinders defining a first nip, each first acceleration cylinder including first surface roll segments radially protruding from the respective first acceleration cylinder and engaging signatures at the first nip; and a pair of second acceleration cylinders positively gripping and transporting the signatures, the second acceleration cylinders defining a second nip, the pair of first acceleration cylinders receiving signatures at a first velocity and a releasing signatures at a second velocity and the pair of second acceleration cylinders receiving the signatures from the pair of first acceleration cylinders and releasing the signatures at a third velocity, the first nip and the second nip being separated by a distance that is slightly shorter than the length of each of the signatures, such that the first acceleration cylinders release each of the signatures as the second acceleration cylinders grip the respective signature and the first and second acceleration cylinders maintain positive control over the signatures during transport.

7. The signature transport apparatus recited in claim 6 wherein the second velocity is greater than the first velocity and the third velocity is greater than the second velocity.

8. The signature transport apparatus recited in claim 6 wherein the second velocity is less than the first velocity and the third velocity is less than the second velocity.

9. The signature transport apparatus recited in claim 6 wherein the first acceleration cylinders each have a radius of a first length and the second acceleration cylinders each have a radius of a second length greater than the first length.

10. The signature transport apparatus recited in claim 6 further comprising a pair of third acceleration cylinders receiving the signatures from the pair of second acceleration cylinders and releasing the signatures at a fourth velocity.

11. A method for transporting printed products in a printing press folder comprising:

cutting a web with a first cutting pair to create partial cuts in the web;

cutting the web at the partial cuts with a second cutting pair to create a signature;

engaging the signature as the signature travels at a first velocity with a pair of first acceleration cylinders after the web is cut into the signature;

accelerating the signature and releasing the signatures from the pair of first acceleration cylinders at a second velocity;

engaging the signature with a pair of second acceleration cylinders just before the signature is released from the pair of first accelerations cylinder so the first and second acceleration cylinders maintain positive control over the signature; and accelerating the signature and releasing the signature from the pair of second acceleration cylinders at a third velocity.

12. The method as recited in claim 11 wherein the second velocity is greater than the first velocity and the third velocity is greater than the second velocity.

13. The method as recited in claim 11 wherein the second velocity is less than the first velocity and the third velocity is less than the second velocity.

14. The method as recited in claim 11 wherein the signature is engaged by the pair of second acceleration cylinders as the signature is released from the pair of first acceleration cylinders.

* * * * *